United States Patent [19]

Lee

[11] Patent Number: 4,460,092

[45] Date of Patent: Jul. 17, 1984

[54] FUR SECURITY SYSTEM

[75] Inventor: Michaelina Lee, Santa Monica, Calif.

[73] Assignee: Licentia Patent-Verwaltungs-GmbH, Frankfurt am Main, Fed. Rep. of Germany

[21] Appl. No.: 230,247

[22] Filed: Feb. 2, 1981

[51] Int. Cl.[3] ..... A47F 7/19

[52] U.S. Cl. ..... 211/4; 70/59; 190/101; 206/287; 223/88

[58] Field of Search ..... 211/4, 7; 223/85, 88; 70/57, 59, 60; 190/41 B, 41 Z; 206/278, 287

[56] References Cited

U.S. PATENT DOCUMENTS

| | | | |
|---|---|---|---|
| 1,043,351 | 11/1912 | Paskell . | |
| 1,322,936 | 11/1919 | Orborski . | |
| 1,713,621 | 5/1929 | Price . | |
| 2,108,853 | 2/1938 | Ghazal . | |
| 2,202,427 | 5/1940 | Polen | 211/4 X |
| 2,350,799 | 6/1944 | Morris | 70/59 |
| 3,378,144 | 4/1968 | Webster | 211/4 |
| 3,834,497 | 9/1974 | Furst | 190/41 B X |
| 3,929,224 | 12/1975 | Smith | 190/41 B X |
| 3,945,543 | 3/1976 | Lazaroff | 223/88 |
| 3,989,327 | 11/1976 | Candelaria | 211/5 X |

FOREIGN PATENT DOCUMENTS

| | | | |
|---|---|---|---|
| 89074 | 7/1922 | Austria | 70/59 |
| 167865 | 7/1904 | Fed. Rep. of Germany | 211/4 |
| 283088 | 6/1913 | Fed. Rep. of Germany | 70/59 |
| 1167190 | 12/1958 | France . | |
| 459263 | 9/1950 | Italy | 223/88 |
| 376793 | 5/1964 | Switzerland . | |

*Primary Examiner*—Ramon S. Britts
*Assistant Examiner*—Robert W. Gibson, Jr.
*Attorney, Agent, or Firm*—Spencer & Frank

[57] ABSTRACT

A long-term security system for use with a horizontal pole rack utilizes a hanger having a standard open loop portion and opposed inclined shoulder confronting portions. The system comprises, in addition to the hanger: a chain of sufficient length so that the chain ends may be passed over the pole, outwardly to the ends of the shoulder confronting portions of the hanger, downwardly through the sleeves of the garment, and inwardly towards each other; hooks at the ends of the shoulder confronting portions of the hanger for supporting the chain so that the segments passing through the sleeves hang freely; and a lock for locking the ends of the chain together to form a closed loop around the pole and through the garment. This system is preferably implemented in combination with a garment bag of the standard zippered variety. The garment bag is provided with a fabric tongue that carries a rigid panel that engages the chain at the sleeve ends to help maintain the chain segments in the sleeves vertical. A short-term security system according to the present invention utilizes first and second mutually engageable locking members affixed to the garment at spatially separate locations (e.g., opposite sleeves) so that the garment may be locked around a stationary object such as the arm of a chair, with the garment forming a closed loop.

9 Claims, 6 Drawing Figures

FUR SECURITY SYSTEM

FIELD OF THE INVENTION

The present invention relates generally to garment security, and more specifically to a system for securing garments to fixed structures.

BACKGROUND OF THE INVENTION

The message that crime doesn't pay seems not to have been adequately communicated to those unscrupulous sorts who form the chain of commerce in stolen fur garments. While it seems almost trite to cite the statistics of skyrocketing crime rates, it is nevertheless important to keep sight of the tremendous burden such crimes impose on society. The theft of a prized fur garment, even if carried out in a non-violent manner, takes a psychic toll on its victim. While the economic loss to a given victim may be offset by theft insurance, this merely spreads the loss among all of those who are forced to pay ever-increasing insurance premiums.

In recent years, the problem of theft from clothing stores has led to a bewildering array of devices and systems designed to curb such theft. One approach seeks to prevent removal from the rack except by authorized store personnel. This approach is exemplified by a system utilizing a chain passing through the garment sleeve, one end of the chain being fastened to the rack, the other end carrying an oversized hoop to prevent withdrawal from the sleeve. An alternate approach is to prevent removal of the garment from the store. This is accomplished by clamping a small radio transmitter or similar device to each garment, and providing an appropriate detector at each store exit.

Unfortunately, once the garment has left the store, the elaborate security precautions are no longer in force, and the garment is subject to theft from the new owner. This condition continues while the garment is in the owner's home, and while the garment is with the owner away from home, whether for long periods, as for example when the owner is traveling, or for short periods, as for example when the owner is attending the theater. The security systems that are presumably effective to prevent theft of garments from the stores are generally not suitable for home use, since they require specialized racks or possibly special electronic surveillance equipment. Even if the owner of an expensive fur garment sees to it that her home is equipped with a specialized rack such as used in stores, she can be relatively assured that the hotel in which she stays, or the theater cloakroom in which she would like to leave her coat will not be so equipped.

Thus, the traffic in stolen furs continues and the owners of expensive fur garments accept the payment of ever-increasing insurance premiums as being the inevitable lesser of two evils.

SUMMARY OF THE INVENTION

The present invention provides the garment owner with short-term or long-term security as needed. The system is simple, inexpensive, and is easily adapted to a wide range of possible environments.

A long-term security system according to the present invention is designed for use with a horizontal pole rack, and utilizes a hanger having a standard open loop portion and opposed inclined shoulder confronting portions. The system comprises, in addition to the hanger: a chain of sufficient length so that the chain ends may be passed over the pole, outwardly to the ends of the shoulder confronting portions of the hanger, downwardly through the sleeves of the garment, and inwardly towards each other; means such as hooks at the ends of the shoulder confronting portions of the hanger for supporting the chain so that the segments passing through the sleeves hang freely; and means for locking the ends of the chain together to form a closed loop around the pole and through the garment.

The system may be easily used to secure two garments by passing one end of the chain through the sleeve of one of the garments and the other end of the chain through the sleeve of the other of the garments. All that is needed is an extra hanger with the hooks at the ends, although in this context, only one hanger hook on each hanger is used.

This system is preferably implemented in combination with a garment bag of the standard zippered variety. However, the garment bag is provided with a fabric tongue between the zipper and the garment bag interior to protect the garment from the zipper and from the lock. The fabric tongue preferably carries a rigid panel that engages the chain at the sleeve ends to help maintain the chain segments in the sleeves vertical.

It can thus be seen that the long-term security system according to the present invention has numerous advantages. Since the system does not rely on a special rack, but rather may be used with any standard pole rack, the wearer can use the system in hotels or other locations. In travelling, the garment bag serves the normal protective function, and the chain may be transported separately, to be positioned once the garment is hung on a rack.

A further advantage is that the chain segments in the sleeves are maintained in a generally vertical orientation and are thus prevented from deforming the garment. This is accomplished by the supporting means (hooks) at the hanger ends which prevent the weight of the chain and lock from collapsing the body of the garment, and the spacer panel on the garment bag tongue which prevents the weight of the chain and lock from collapsing the sleeves toward each other.

A short-term security system according to the present invention utilizes first and second mutually engageable locking members affixed to the garment at spatially separate locations (e.g., opposite sleeves) so that the garment may be locked around a stationary object such as the arm of a chair, with the garment forming a closed loop. In the context of a fur garment with a fabric lining inside the skin surface of the fur, the locking members are preferably mounted to small brackets sewn to the skin, with the locking members protruding through the lining. The locking members are preferably encased within small fabric pouches to protect the lining and avoid discomfort to the wearer. Each mounting bracket is preferably of a hinged configuration with the hinge pin being defined by a ring to which an associated locking member is mounted.

The short-term security system according to the present invention has the advantage that it is unobtrusive, and yet is always available for use. The hinged mounting bracket is advantageous since it is flexible. Also, the hingedly connected portions may assume an aligned position for easy insertion through a small hole in the lining, and an opposed position for mounting to the skin.

For a further understanding of the nature and advantages of the present invention, reference should be made to the remaining portion of the specification and to the attached drawings.

DETAILED DESCRIPTION OF THE INVENTION

Long-Term Security System

Figure 1:
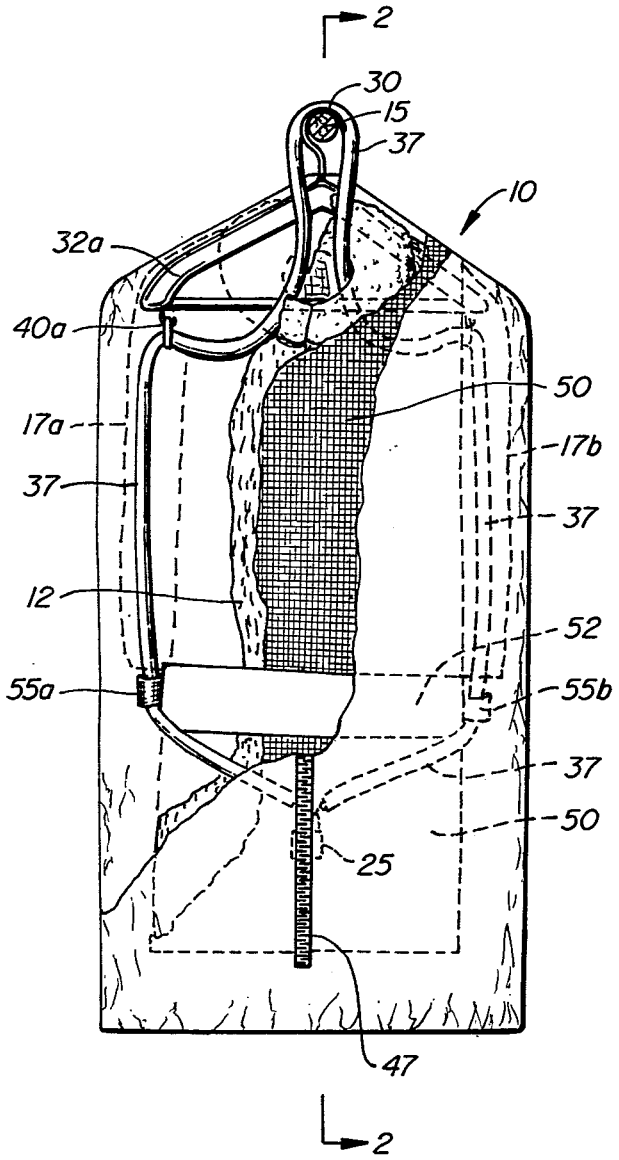
FIG. 1 is a partly cut away front view of a long-term security system according to the present invention.
Figure 2:
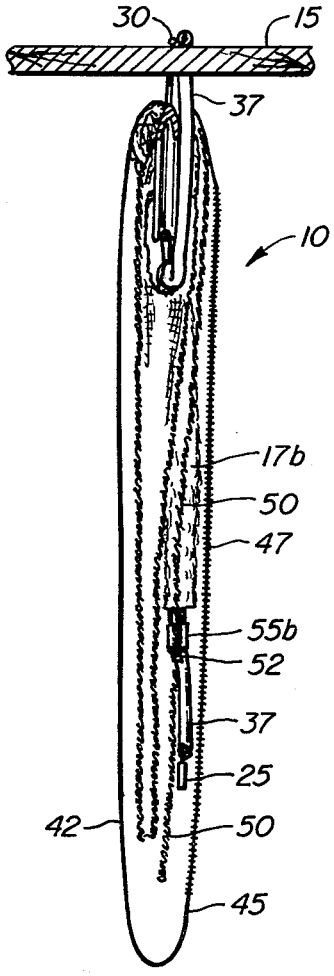
FIG. 2 is a side sectional view of the long-term security system.

FIGS. 1 and 2 are a partly cut away front view and a side sectioned view, respectively, illustrating a long-term security system 10 suitable for securing a sleeved garment 12 to a horizontal pole 15. Pole 15 may be mounted within a closet or may be a portion of a self-contained pole rack. Garment 12 has first and second sleeves 17*a* and 17*b*, and while system 10 may be used with any sleeved garment, it is envisioned that garment 12 will typically be a fur coat or jacket.

Figure 3:
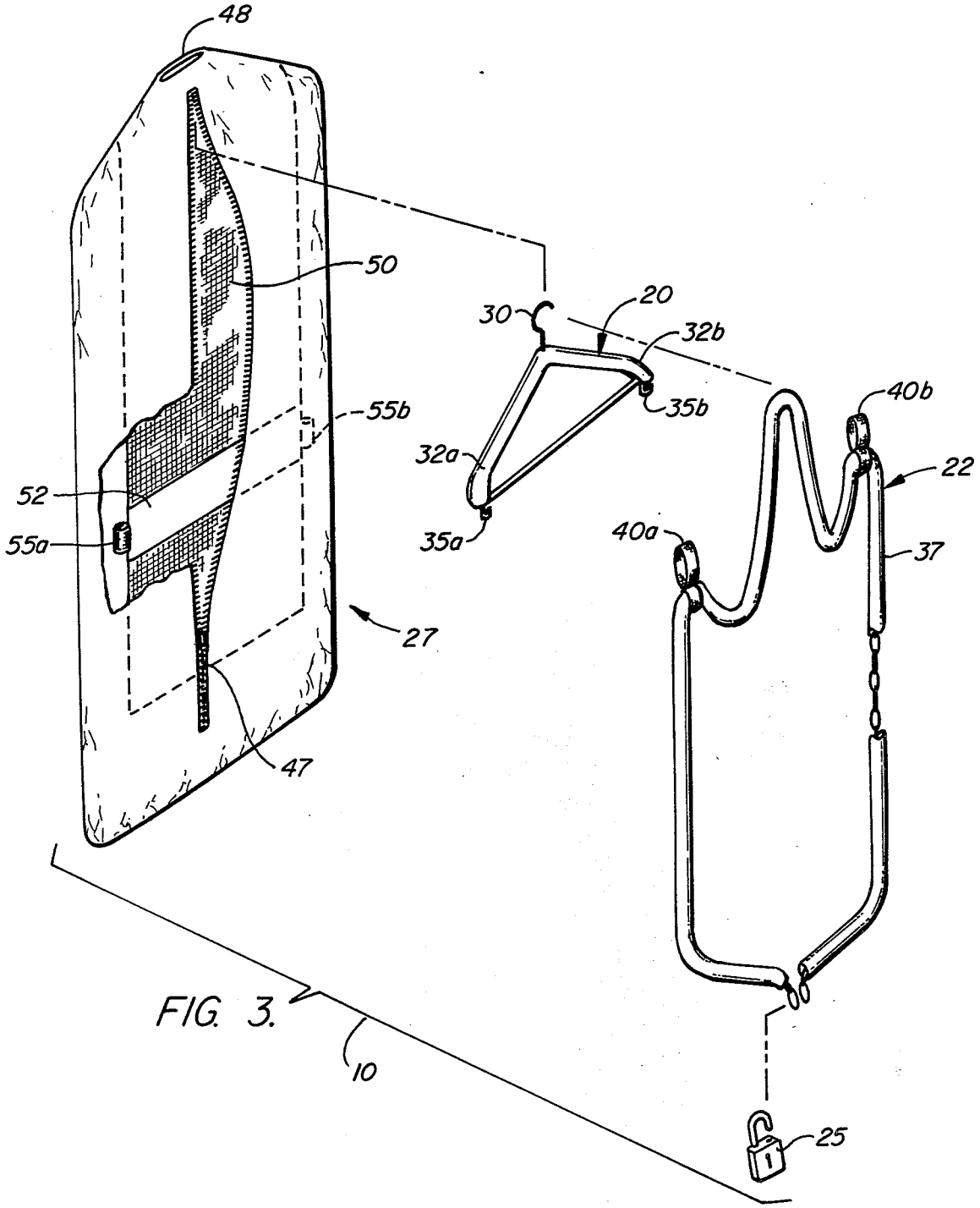
FIG. 3 is a partly cut away exploded view of the long-term security system.

The construction of system 10 may best be seen with additional reference to the partly cut away exploded view of FIG. 3. Broadly, system 10 comprises a hanger 20, a chain 22, a lock 25, and a garment bag 27. Hanger 20 is of generally conventional design and includes an open loop portion 30 for engaging pole 15, and a body having opposed shoulder confronting portions 32*a* and 32*b*. The hanger body is of any conventional construction and may be made of wood or plastic contoured to provide a distributed support area for the insides of the shoulders of garment 12. Hanger 20 carries small depending hooks 35*a* and 35*b*, each mounted to the underside of a respective shoulder confronting portion. Hooks 35*a* and 35*b* may be standard cup hooks screwed into the body.

Chain 22 is a case hardened chain having a length of approximately 7–8 feet, the significance of which will be described below. Chain 22 is preferably covered with a fabric sheath 37 having loops 40*a* and 40*b* located on opposite sides of the midpoint of the chain at a spacing of approximately 3 feet. Lock 25 is a case hardened key or combination padlock of any convenient standard design.

Garment bag 27 is of generally conventional design, having a flexible rear panel 42 and a flexible front panel 45. Front panel 45 is provided with a zipper 47 down its center so that the user may gain access to the bag interior. The garment bag is formed with an opening 48 at the top to accommodate open loop portion 30 of hanger 20. A generally rectangular fabric tongue 50 is mounted to the upper portion of front panel 45 inside the bag so as to be interposed between a garment and the front panel 45. Tongue 50 carries a relatively rigid spacer panel 52 and fabric loops 55*a* and 55*b* along opposite edges thereof, being separated by spacer panel 52. Panel 52 may be fabricated from cardboard, plastic, or any convenient material. Panel 52 has a width generally commensurate with the spacing between hooks 35*a* and 35*b*, 18 inches being typical.

Having described the separate components of security system 10, the implementation may now be described. In use, garment 12 is placed on hanger 20 within garment bag 27, with open loop portion 30 protruding through top opening 48, and the assembly of garment, garment bag and hanger is supported from pole 15. Chain 22 is placed with its central portion draped over pole 15, and each end is passed downwardly through top opening 48, outwardly to a respective hanger hook, downwardly through a respective one of loops 55*a* and 55*b* on tongue 50, and inwardly towards the center so that the two chain ends may be locked together by lock 25. Chain 22 forms a closed loop through the sleeves of the garment and around pole 15, thus positively locking garment 12 to pole 15 and preventing the removal of the garment without cutting the chain, the lock, or the garment.

Loops 40*a* and 40*b* on sheath 37 engage hanger hooks 35*a* and 35*b*, respectively, so that the chain segments within sleeves 17*a* and 17*b* are maintained in a generally vertical orientation. More particularly, since the chain segments are supported from the opposite ends of the hanger, the weight of the chain and lock is prevented from collapsing the upper body portions of garment 12 inwardly. Moreover, since the chain segments pass through loops 55*a* and 55*b*, the weight of the lower chain portion and lock is prevented from collapsing the sleeves inwardly towards each other. Thus, garment 12 is allowed to hang in a normal manner, unaffected by the weight of chain 22 and lock 25. Fabric tongue 50 protects garment 12 from zipper 47, and further from lock 25.

It is possible to secure two garments with the same general arrangement by passing one end of the chain through a sleeve of the first garment and the other end of the chain through a sleeve of the second garment, with the two chain ends being locked together as in the single garment case.

It is possible to implement system 10 without a pole rack, so long as there is a nearby fixed object through or around which the chain may be looped. However, the chain is normally sized under the assumption that it will be draped over a pole at the top of the hanger, thus placing a relatively severe constraint on the location of such a fixed object relative to the hanger.

It is possible to implement system 10 without garment bag 27, although the benefits provided by spacer panel 52 are lost. However, hanger hooks 35*a* and 35*b* and loops 40*a* and 40*b* of sheath 37 still cooperate to generally prevent deformation of the garment.

Short-Term Security System

Figure 4:
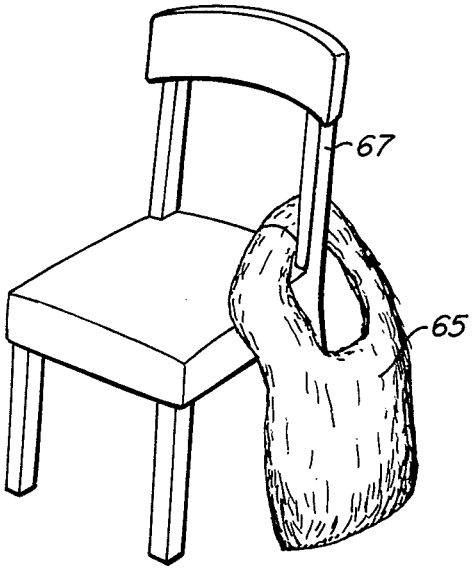
FIG. 4 is a perspective view illustrating the use of a short-term security system according to the present invention.

FIG. 4 is a perspective view illustrating the use of a short-term security system according to the present invention for securing a garment 65 to a convenient fixed structure such as a chair 67. This is accomplished by locking spatially separate portions of the garment together to form a closed loop that surrounds an appropriate portion of the fixed structure to prevent separation of the garment.

Figure 5:
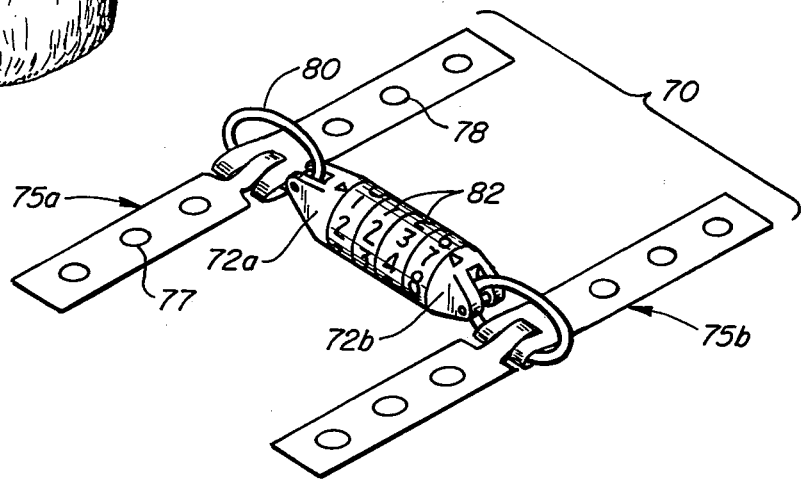
FIG. 5 is an isometric view of the short-term security system.

FIG. 5 is an isometric view illustrating a short-term security system 70 suitable for use as shown in FIG. 4. Broadly, system 70 comprises first and second mutually engageable locking members 72*a* and 72*b*, and first and second mounting brackets 75*a* and 75*b* for mounting the locking members to respective spatially separated portions of garment 65. In most instances, garment 65 will be a sleeved garment such as a fur coat or jacket, with the locking members being mounted in opposite sleeves.

Mounting brackets 75*a* and 75*b* are typically of identical construction, and only bracket 75*a* will be described. Bracket 75*a* is of hinged construction having first and second hinge portions 77 and 78, and a ring 80. Hinge portions 77 and 78 are generally strip-like, each approximately 1.5–2 inches by ¼–178 inch and having a tubular end region to accommodate a common hinge pin. Ring 80 passes through the aligned tubular end regions of hinge portions 77 and 78 to define the hinge pin, and locking member 72*a* is mounted to ring 80.

Locking members 72*a* and 72*b* are preferably cooperating portions of a tubular combination lock having a plurality of disks 82 which must all be aligned in a particular way to permit separation of the two cooperating portions. Each locking member is slotted to receive a respective ring, and includes a pin for retaining the ring.

Figure 6:
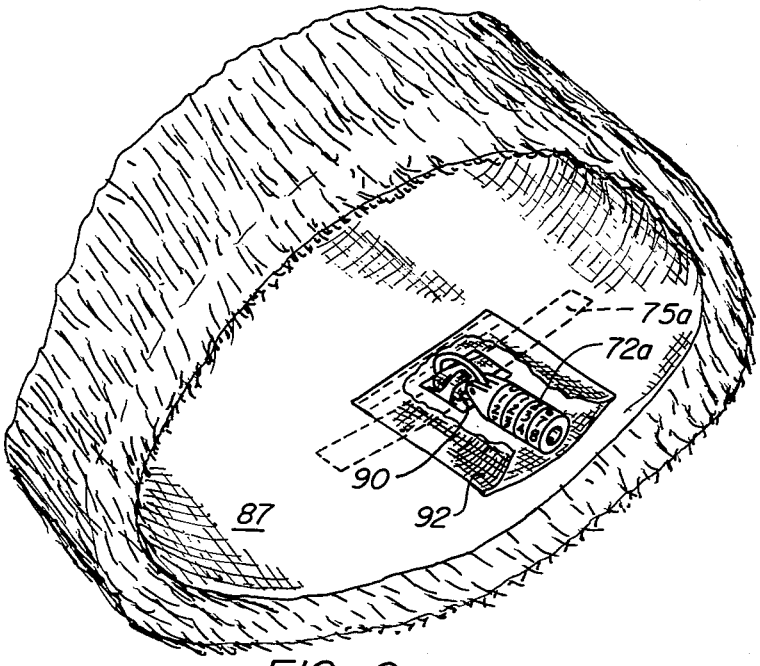
FIG. 6 is a perspective view illustrating the mounting of one of the locking members in a sleeve of a garment.

As discussed above, locking members 72*a* and 72*b* are typically mounted within opposite sleeves of a garment. FIG. 6 is a perspective view illustrating a preferred mounting regime for locking member 72*a* and mounting bracket 75*a* within a sleeve 85. Typically, the fur garment has a lining 87 on the skin side 90 of the fur. Hinge portions 77 and 78 are sewn directly to the skin side of the fur, with ring 80 protruding through the lining so that locking member 72*a* is located on the side of the lining remote from the fur. Prior to sewing hinge portions 77 and 78 to the skin side of the fur, the fur is "built up" at the location of attachment by sewing a piece of interfacing to the skin side. This strengthens the fur and protects it from the bracket. A 1-inch by 4-inch piece of interfacing is suitable. A padded pouch 92 is sewn to lining 87 and surrounds locking member 72*a* so that when system 70 is not in use, the locking member is completely surrounded and thus does not snag on the wearer's clothing or cause an unpleasant sensation to the wearer.

The hinged configuration of the mounting brackets facilitates installation which proceeds as follows. Hinge portions 77 and 78 are first aligned in a parallel or closed position so that the bracket may be easily pushed through a small hole in the lining. The hinge portions are then spread apart into an opposed configuration and sewn to the built up portion of the fur. The hinged configuration, in addition to facilitating the insertion, has the advantage that a relatively large mounting area is provided while maintaining flexibility. Mounting within the sleeves is typically done with the brackets extending transversely.

In summary, it can be seen that the present invention provides both long-term and short-term security for the owner of a garment such as a fur coat or jacket. The long-term security system is not tied to any particular location, but may be used in cooperation with any convenient pole rack. The short-term security system is unobtrusive, and yet the wearer of the garment is never in a situation where the system is unavailable.

While the above provides a full and complete description of the preferred embodiments of the invention, various modifications, alternate constructions, and equivalents may be employed without departing from the true spirit and scope of the invention. For example, while hooks were disclosed as the supporting means for keeping the chain segments vertical within the sleeves of the garment in the long-term security system, snap fasteners or "Velcro" fasteners may be used. Moreover, spacer panel 52 and loops 55*a* and 55*b* could be formed as a unit separable from fabric tongue 50 so that the benefits of the panel would be available, even when garment bag 27 was not used. Therefore, the above description and illustration should not be construed as limiting the scope of the invention which is defined by the appended claims.

I claim:

1. A system for locking a sleeved garment to a horizontal pole comprising:

a hanger having an open loop portion for supporting said hanger from said pole, and opposed shoulder confronting portions;

a chain having ends and being of sufficient length so that the chain ends may be passed over said pole, outwardly to the ends of said shoulder confronting portions, downwardly through the sleeves of said garment, and inwardly towards each other;

releasable means for supporting said chain from points near the outer ends of said shoulder confronting portions to keep said chain spaced at the upper ends of said sleeves;

a garment bag for enclosing said garment supported on said hanger;

chain spacing means associated with said garment bag for spacing said chain apart at the lower ends of said sleeves so that portions of said chain passing through said sleeves are disposed substantially vertically within said sleeves; and means for locking the ends of said chain together to form a closed loop extending over said pole and through said sleeves.

2. The invention of claim 1 wherein said releasable supporting means comprises:

first and second hooks near respective outer ends of said shoulder confronting portions of said hanger; and means on said chain for engagement with said hooks.

3. The invention of claim 2, and further comprising a smooth sheath covering said chain, and wherein said means for engagement comprises first and second loops sewn to said sheath.

4. The invention of claim 1, and further comprising means for spacing said chain apart at the lower ends of said sleeves so that it is disposed substantially vertically within said sleeves.

5. The invention of claim 1 wherein:

said garment bag has a zipper opening and a fabric tongue mounted in said garment bag opposite said zipper to protect said garment from said zipper and further to protect said garment from said locking means holding said chain ends together; and said chain spacing means comprises a rigid panel mounted on said tongue, and opposed chain engaging portions at opposite edges of said panel to maintain said chain in a generally vertical orientation over those segments within the sleeves of said garment.

6. A system for securing a sleeved garment to a pole rack comprising:

a hanger having an open loop portion and first and second opposed shoulder confronting portions;

a chain of sufficient length that the ends of the chain may be passed over said pole, outwardly to the ends of said shoulder confronting portions, downwardly through the sleeves of said garment, and toward each other;

releasable means for supporting said chain at the ends of said shoulder confronting portions to prevent the weight of said chain and lock from collapsing the upper body portions of said garment inwardly towards one another;

means for locking the ends of said chain together to form a closed loop over said pole rack and through said sleeves;

a garment bag sized to surround said garment on said hanger and having a zipper opening;

a fabric tongue mounted within said garment bag opposite said zipper opening to protect said garment;

a rigid panel carried by said fabric tongue; and opposed chain engaging portions at opposite edges of said panel to prevent the weight of said chain and lock from collapsing said sleeves toward one another.

7. A system for locking a sleeved garment to a horizontal pole comprising:

a hanger having an open loop portion for supporting said hanger from said pole, and opposed shoulder confronting portions;

a chain having ends and being of sufficient length that the chain ends may be passed over said pole, outwardly to the ends of said shoulder confronting portions, downwardly through the sleeves of said garment, and inwardly to meet;

first and second hooks depending from the undersides of respective outer ends of said shoulder confronting portions of said hanger;

a smooth sheath covering said chain;

first and second loops sewn to said sheath for engagement with said hooks, whereby portions of said chain are supported spaced apart at the upper ends of said sleeves; and means for locking the ends of said chain together to form a closed loop extending over said pole and through said sleeves.

8. The invention of claim 7, and further comprising a garment bag for enclosing said garment supported on said hanger, said garment bag including chain spacing means for spacing said chain apart at the lower ends of said sleeves so that it is disposed substantially vertically within said sleeves.

9. A system for locking a sleeved garment to a horizontal pole comprising:

a hanger having an open loop portion for supporting said hanger from said pole, and opposed shoulder confronting portions;

a chain having ends and being of sufficient length so that the chain ends may be passed over said pole, outwardly to the ends of said shoulder confronting portions, downwardly through the sleeves and said garment, and inwardly towards each other;

releasable means for supporting said chain from points near the outer ends of said shoulder confronting portions to keep said chain spaced at the upper ends of said sleeves;

a rigid member distinct from said garment for spacing said chain apart at the lower ends of said sleeves so that said chain is disposed substantially vertically with said sleeves; and means for locking the ends of said chain together to form a closed loop extending over said pole and through said sleeves.

* * * * *

UNITED STATES PATENT AND TRADEMARK OFFICE

CERTIFICATE OF CORRECTION

PATENT NO. : 4,460,092

DATED : July 17, 1984

INVENTOR(S) : Michaelina Lee

It is certified that error appears in the above-identified patent and that said Letters Patent is hereby corrected as shown below:

On the title page Item (73) Assignee: " Licentia Patent-Verwaltungs-GmbH, Frankfurt am Main, Fed. Rep. of Germany" should be deleted.

Attorney, Agent, or Firm- "Spencer & Frank" should read --Townsend and Townsend--.

Signed and Sealed this

*Twentieth* Day of *August 1985*

[SEAL]

*Attest:*

DONALD J. QUIGG

*Attesting Officer*

*Acting Commissioner of Patents and Trademarks*